US008028619B2

(12) United States Patent
Lee et al.

(10) Patent No.: US 8,028,619 B2
(45) Date of Patent: Oct. 4, 2011

(54) COOKING APPARATUS

(75) Inventors: Young Woo Lee, Seoul (KR); Wan Soo Kim, Seoul (KR); Hyun Jung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 968 days.

(21) Appl. No.: 11/925,486

(22) Filed: Oct. 26, 2007

(65) Prior Publication Data

US 2008/0105140 A1 May 8, 2008

(30) Foreign Application Priority Data

Oct. 26, 2006 (KR) ..... 10-2006-0104530

(51) Int. Cl.
*F24C 15/04* (2006.01)
*F23M 7/00* (2006.01)

(52) U.S. Cl. ..... 99/474; 126/198; 126/193; 126/287

(58) Field of Classification Search ..... 99/474; 126/198, 193, 190, 21 A, 287; 219/391, 219/400

See application file for complete search history.

(56) References Cited

U.S. PATENT DOCUMENTS

| | | | | |
|---|---|---|---|---|
| 42,935 | A * | 5/1864 | Miller | 126/193 |
| 5,329,920 | A * | 7/1994 | Brazier | 126/344 |
| 7,263,989 | B2 * | 9/2007 | Yamauchi et al. | 126/192 |
| 7,708,007 | B2 * | 5/2010 | Kim et al. | 126/198 |
| 7,847,219 | B2 * | 12/2010 | Kim et al. | 219/391 |

* cited by examiner

*Primary Examiner* — Reginald L Alexander

(74) *Attorney, Agent, or Firm* — Birch, Stewart, Kolasch & Birch, LLP

(57) ABSTRACT

A cooking apparatus including a cooking chamber having an opening, a door configured to open and close the opening of the cooking chamber, the door including a channel and an inlet to allow communication between the cooking chamber and the channel, and an opening/closing unit to open and close the inlet in the door. A door including a first surface, a second surface spaced from the first surface to define a channel between the first surface and the second surface, an inlet formed in the second surface, the inlet being in flow communication with the channel, an outlet formed in one of the first surface and the second surface, the outlet being in flow communication with the channel, and an opening/closing unit to open and close the inlet in the second surface is also provided.

13 Claims, 20 Drawing Sheets

COOKING APPARATUS

CROSS-REFERENCE TO RELATED APPLICATIONS

This application claims the benefit of Korean Patent Application No. 10-2006-0104530, filed on Oct. 26, 2006, which is hereby incorporated by reference in its entirety.

BACKGROUND OF THE INVENTION

1. Field of the Invention

The present invention relates generally to a door for a cooking apparatus and a cooking apparatus having the same, and more particularly a door for a cooking apparatus having an opening/closing unit to open/close an inlet in the door and a cooking apparatus having the same.

2. Description of Related Art

Generally, a related art cooking apparatus includes a cooking chamber for heating food therein using heat generated from a heater or microwaves from a magnetron. The cooking apparatus usually includes a cabinet surrounding the cooking chamber and a door connected to the cabinet for closing the cooking chamber. In the related art cooking chamber, the external appearance of the cooking apparatus is easily stained because of pollutants generated during the cooking process. These pollutants may take the form of food scraps, sauces, fats, food particulates, and steam generated during the cooking process.

In addition to pollutants on the exterior of the cooking apparatus, pollutants can enter into the interior of the cooling apparatus through a gap in the cooking apparatus, particularly the interior of the door. Generally, it is more difficult to remove pollutants from the interior of the door as compared to removing pollutants from the exterior of the cooking apparatus and the interior of the cooking chamber. Furthermore, in some cases, a user of the cooking apparatus may not know that pollutants have entered into the interior of the door and, subsequently, the pollutants may generate a bad smell due to the rotting of the pollutants in the door of the cooking apparatus. Therefore, it is difficult to maintain the cleanness of the cooking apparatus and the overall quality of the cooking apparatus may be deteriorated over time.

BRIEF SUMMARY OF THE INVENTION

Accordingly, the present invention has been proposed in order to solve the above problems of the prior art. It is an object of the present invention to provide a cooking apparatus capable of maintaining a clean appearance by easily discharging the pollutants entered into the inner space by means of gravity as well as provide for easier cleaning thereof.

According to principles of this invention, a cooking apparatus is provided that includes a cooking chamber having an opening, a door configured to open and close the opening of the cooking chamber, the door including a channel and an inlet to allow communication between the cooking chamber and the channel, and an opening/closing unit to open and close the inlet in the door.

In another aspect, the channel of the door may include an air-gap located in the door and the inlet may be formed on a surface of the door closest to the cooking chamber. The inlet is connected to at least one side of the air-gap.

In a different aspect, the opening/closing unit may include a cover member located in the door so that the inlet of the door can be opened and closed by the weight of the cover member based on whether the door is in an open position or a closed position. The cover member may be located substantially adjacent the inlet of the door and may be pivotally connected to the door by a hinge positioned below the inlet of door.

In a further aspect, the cover member may include a cover part configured to open and close the inlet of the door, and a base part extended from the cover part such that the center of gravity of the cover member is located beneath the hinge when the door is in the open position and the closed position. The base part may be formed of the same material as the cover part and has a larger mass than the cover part. Alternatively, the opening/closing unit may include a mass member connected to the base part.

In a different aspect, the cooking apparatus may include a cabinet and the cooking chamber may be located in the cabinet. In addition, the opening/closing unit may include a cover member pivotally connected to the door by a hinge, an elastic member provided between the door and the cover member to bias the cover member to close the inlet of the door, and a push rod projected from the cabinet to push the cover member away from the inlet of the door when the door is in the closed position.

In still another aspect, the opening/closing unit may include a cover member configured to open and close the inlet of the door, and an actuator configured to move the cover member between an open position and a closed position.

In a further aspect, the cooking apparatus may include a door sensor configured to sense whether the door is in a closed position or an open position, the actuator being controlled by a signal from the door sensor based on whether the door is in the closed position or the open position.

In another aspect, the cooking apparatus may include a pressable switch configured to send a signal to the actuator to move the cover member between the open position and the closed position.

In yet another aspect, the actuator may include a motor located on the door and a power transfer unit connected to the cover member. The power transfer unit may be configured to translate rotational power from the motor to cause the cover member to move between the open position and the closed position. For example, the power transfer unit may include a pinion gear coupled to the motor and a rack gear coupled to the cover member.

In still another aspect, the actuator may include a motor coupled to the door to cause the cover member to be rotated between the open position and the closed position.

In a different aspect, the cooking apparatus may include a cabinet having a blowing channel positioned at the outside of the cooking chamber and a blower to generate airflow in the blowing channel. In this aspect, the airflow passes through the door inlet when the door is in the closed position.

According to principles of the present invention, a cooking apparatus is provided that includes a cooking chamber having an opening, a door configured to open and close the opening of the cooking chamber, the door including a gaseous flow path and an inlet to allow communication between the cooking chamber and the gaseous flow path, and an opening/closing unit to open and close the inlet in the door.

Other aspects of the cooking apparatus are similar to those described above.

In addition to the cooking apparatuses described above, a door for a cooking apparatus according to the principles of the present invention includes a first surface, a second surface spaced from the first surface to define a channel between the first surface and the second surface, an inlet formed in the second surface, the inlet being in flow communication with the channel, an outlet formed in one of the first surface and the second surface, the outlet being in flow communication with the channel, and an opening/closing unit to open and close the inlet in the second surface.

In a further aspect, the opening/closing unit may include a cover member located in the door so that the inlet in the second surface can be opened and closed by the weight of the cover member based on whether the door is in a vertical position or a horizontal position.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain principles of the disclosure. In the drawings.

DETAILED DESCRIPTION OF THE INVENTION

Reference will now be made in detail to several exemplary embodiments of a cooking apparatus according to the present invention, examples of which are illustrated in the accompanying drawings. Wherever possible, the same reference numbers will be used throughout the drawings to refer to the same or like parts.

Figure 1:
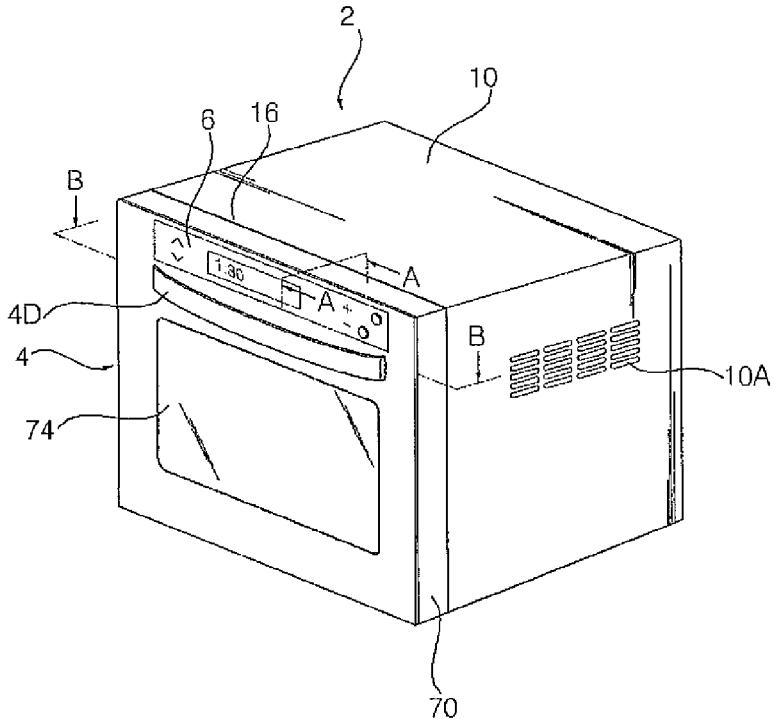
FIG. 1 is a perspective view of an external appearance of a cooking apparatus according to a first embodiment of the present invention when the door thereof is closed.
Figure 2:
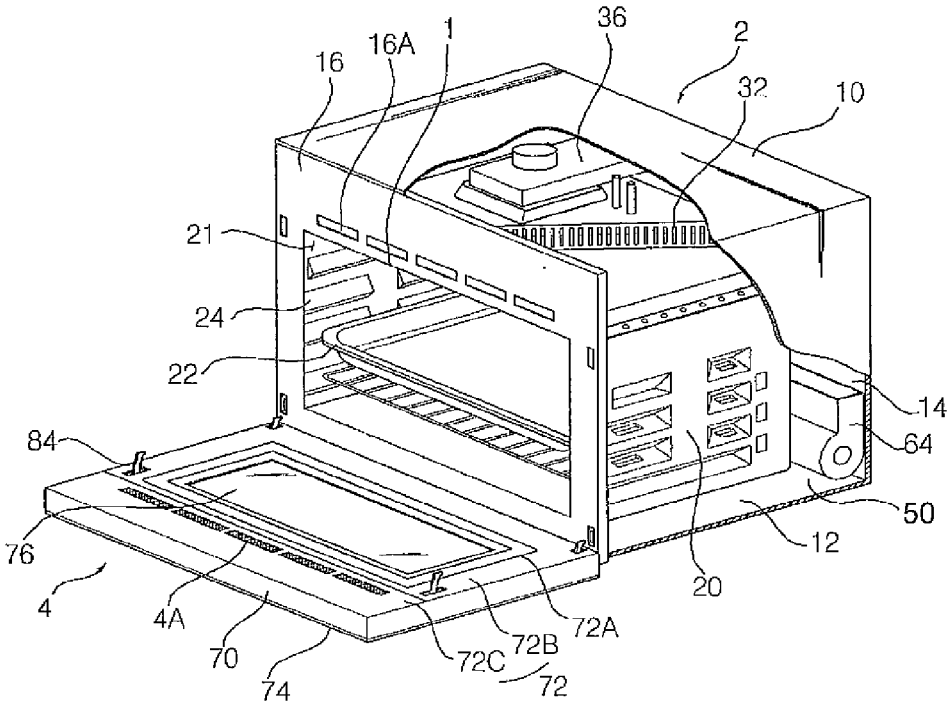
FIG. 2 is a perspective view of the cooking apparatus of FIG. 1 where the door thereof is opened and with a portion of the cabinet removed.

As shown in FIGS. 1 and 2, a cooking apparatus according to a first embodiment includes a cabinet 2 having an opening 1 located in the front surface thereof A door 4 is pivotally attached by a hinge (not shown) to the cabinet 2 so that the opening 1 can be opened and closed. A control panel 6 is installed in either the cabinet 2 or the door 4 and allows a user to control the operation of the cooking apparatus and/or to see the current operating conditions of the cooking apparatus. The door includes an air-gap 3 in the fowl of a channel, which will be described in greater detail below.

The cabinet 2 includes a frame 10 that defines right and left surfaces and an upper surface of the cabinet 2, a base 12 disposed on a lower side of the frame 10 to form a bottom of the cabinet 2, a rear plate 14 disposed at the rear of the frame 10 to form a rear surface of the cabinet 2, and a front plate 16 disposed in the front of the frame 10. The front plate 16 includes the opening 1 therein. A cabinet inlet 10A is formed in at least one of the right surface of the frame 10, the left surface of the frame 10, and the rear plate 14 so that external air can be sucked into the inside of the cabinet 2.

At least one cabinet outlet 16A is formed in the front plate 16 so that the air in the cabinet 2 can be discharged out of the cabinet 2. The cabinet outlet 16A can be positioned in the part of the cabinet 2 opposite the door 4 when the door 4 is closed so that cooling air flow provided by a cooling unit 60 is discharged from the cabinet 2 through the cabinet outlet 16A to air-cool the door and/or the control panel 6. In particular, the cabinet outlet 16A can be positioned on the upper side of the opening 1. The cabinet outlet 16A can be formed in a slot shape that extends in the right and left directions of the cabinet 2. As shown in FIG. 2, a plurality of cabinet outlets 16A are arranged in the right and left directions of the cabinet 2. The opening 1 can be positioned in the up and down directions of the cabinet 2 so that it can cooperate with the cooking chamber opening 21.

The inside of the cabinet 2 is provided with a cooking chamber 20 where food is received and cooked therein. The cooking chamber 20 can be positioned in the up and down directions within the cabinet 2. The cooking chamber 20 has a cooking chamber opening 21 corresponding to the opening 1 in the front surface thereof so that food can be placed in and removed from the cooking chamber 20. The cooking chamber opening 21 can be opened and closed by the door 4.

A rack 22 is located in the cooking chamber 20 and is configured to support food thereon. Rack rails 24 may be provided on the respective right and left inner walls of the cooking chamber 20 to support the edges of the rack 22, thereby allowing the rack 22 to be inserted into and removed from the cooking chamber 20. By providing a plurality of rack rails 24 in the respective up and down directions of the cooking chamber 20, the up and down position of the rack 22 in the cooking chamber 20 can be controlled.

The inside of the cabinet 2 is provided with one or more heat sources for heating the inside of the cooking chamber 20. For example, in order to uniformly disperse heat while the temperature of the inside of the cooking chamber 20 rapidly rises and to provide for different types of cooking, a variety of different heat sources may be provided. The heat sources include an upper heat source that provides heat from the upper side of the cooking chamber 20 to the cooking chamber 20. In this exemplary embodiment, the upper heat source can include an upper heater 32 positioned on the upper side of the cooking chamber 20 to generate heat by electricity. The heat sources also include a lower heat source that provides heat from the lower side of the cooking chamber 20 to the cooking chamber 20. The lower heat source can include a lower heater 34 positioned on the lower side of the cooking chamber 20 to generate heat by electricity. The upper heater 32 can provide heat to the cooking chamber 20 in a conductive manner and the lower heater 34 can provide heat to the cooking chamber 20 in a convection manner by being connected to the cooking chamber 20 through a lower heater duct (not shown). The heat sources include a magnetron 36 capable of providing a high frequency heat source to the inside of the cooking chamber 20. The magnetron 36 can be located on the upper side of the cooking chamber 20 in the cabinet 2. Finally, the heat source can include a convection heat source 40 positioned in the rear of the cooking chamber 20 to provided forced convection heat to the cooking chamber 20.

Also, in the inside of the cabinet 2, a machine room 50 is positioned in the rear of the cooking chamber 20 in the cabinet or on the upper side of the cooking chamber 20 and is connected to the control panel 6 to be communicable therewith to control the operation of the cooking apparatus including the heat sources. Also, a cooling unit 60 capable of cooling the machine room, the door 4, and/or the control panel 6 is provided inside the cabinet 2.

The cooling unit 60 includes a blowing channel 62 connecting the cabinet inlet 10A to the cabinet outlet 16A. The blowing channel is provided outside the cooking chamber 20 in the cabinet 2 so as to pass through the machining room 50. A blower 64 is positioned in the blowing channel 62 and provides cooling airflow from the cabinet inlet 10A towards the cabinet outlet 16A. The blowing channel 62 can be a duct structure. Also, since the machine room 50 is positioned at the rear of the cooking chamber 20 in the cabinet 2 or on the upper side of the cooking chamber 20, the rear of the cooking chamber 20 in the cabinet 2 and the upper side of the cooking chamber 20 can serve as the blowing channel 62. The blower 64 can be positioned in the rear of the cooking chamber 20 in the cabinet 2, it can be positioned to the right and left of the cooking chamber 20 in the cabinet 2, and it can be positioned on the upper side of the cooking chamber 20 in the cabinet 2.

The door 4 is pivotally connected to the cabinet 2 through a hinge (not shown) such that it can move between an open position and a closed position while being rotated up and down about the lower side of the door 4. Also, the door 4 can be locked in the state that the door is closed or can be connected to the cabinet 2 through a door latch 84. For ease of reference, because the door 4 is stood approximately vertical when the door is closed and is approximately horizontal when the door is opened, the length of the door 4 in the up an down directions when the door 4 and is closed is referred to as the length of the door 4, the length of the door 4 in the right and left directions when the door 4 is closed is referred to as the width of the door 4, the depth of the door 4 in the front and rear directions when the door 4 is closed is referred to as the thickness of the door 4, and the side of the door opposite the hinge is referred to as the upper side of the door 4.

The door 4 includes a first door panel 70 forming a front surface on the outside of the door 4 furthest from the cooking chamber 20, and a second door panel 72 forming a back surface on the inside of the door 4 that is positioned between the first door panel 70 and the cooking chamber 20 when the door 4 is closed. An air-gap 3 in the form of a channel is formed between the first door panel 70 and the second door panel 72. The first door panel 70 may have a box shape and include a first opening 70B, which is shielded by the second door panel 72. The first door panel 70 is sized to cover the opening 1 in the cabinet 2 as well as the front plate 16 of the cabinet 2.

In the first door panel 70, a first outer opening 70D allows the interior of the cooking chamber 20 to be viewed through the door 4. The first outer opening 70D may be sized to correspond to the cooking chamber opening 21 so that the inside of the cooking chamber 20 can be seen when the door 4 is closed. An outer glass 74 is attached to the first door panel 70 to cover the first outer opening 70D. The outer glass 74 may be sized to cover the first outer opening 70D as well as the whole first door panel 70. The outer glass 74 is positioned in an exterior surface of the first door panel 70 when the door 4 is closed.

Figure 3:
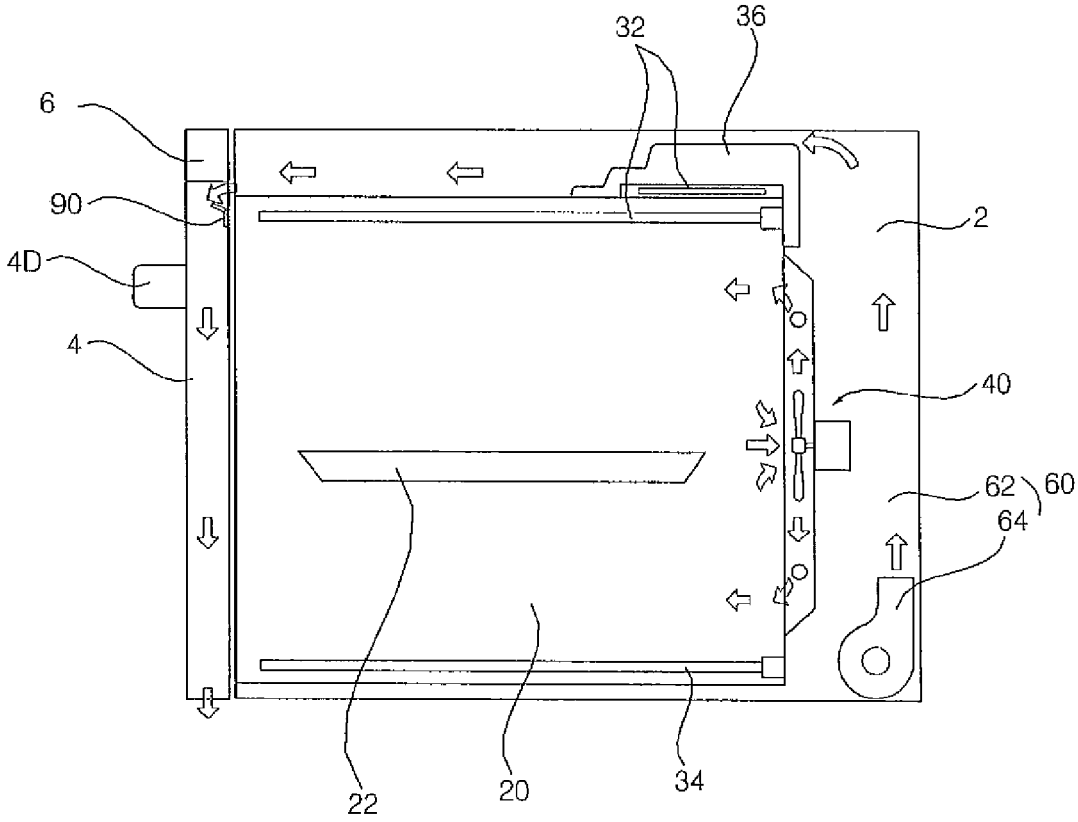
FIG. 3 is a schematic view of the cooking apparatus of FIG. 1.

The second door panel 72 is coupled to the first door panel 70 so that it shields the first opening 70B. The second door panel 72 can be formed as a single door panel or divided into two or more door panels. As shown in FIGS. 1 and 3, the second door panel 2 includes a base panel 72B, and an upper panel 72C disposed above the base panel 72B. In the second door panel 72, a second door panel opening 72A is provided so that the interior of the cooking chamber 20 is visible through the door 4. The second door panel opening 72A is positioned in the base panel 72B to correspond to the cooking chamber opening 21 so that the inside of the cooking chamber 20 is visible when the door 4 is closed. In the second door panel opening 72A, an inner glass 76 configured to shield the second door panel opening 72A is disposed. Also, the lower side of the second door panel 72 can be provided with a part of the hinge (not shown). The upper side of the second door panel 72 is provided with a part of the door latch 84.

In addition, a middle glass 78 is provided in the door 4 between the first door panel 70 and the second door panel 72 that divides the air-gap 3 in a thickness direction of the door 4. The portion of the air-gap 3 between the middle glass 78 and the first door panel 70 is open and the portion of the air-gap 3 between the middle glass 78 and the second door panel 72 is air-tight.

To assist in cooling the door during and after a use of the cooking apparatus, the door includes a door inlet 4A allowing one side of the air-gap 3 and the exterior of the door 4 to be in communication with each other, and a door outlet 4B allowing other side of the air-gap 3 and the exterior of the door to be in communication with each other. The door inlet 4A and the door outlet 4B can be spaced from each other in a length direction of the door 4 and can be spaced from each other in a width direction in order that the whole door 4 can be evenly air-cooled. For example, the door inlet 4A is positioned on the upper side of the door 4 and the door outlet 4B is positioned on the lower side of the door 4.

Figure 4:
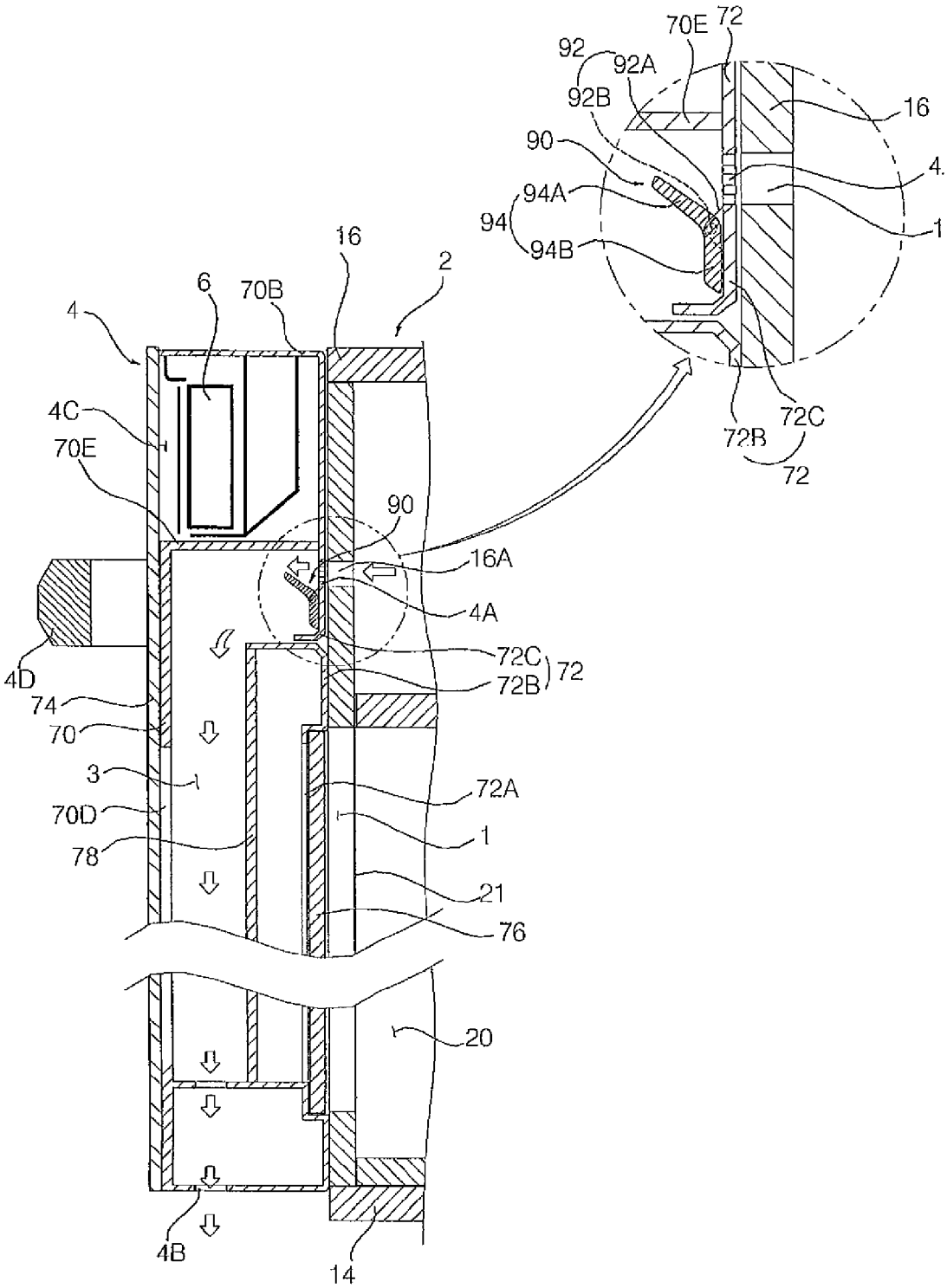
FIG. 4 is a partial cross-sectional view taken along line A-A in FIG. 1.

The door inlet 4A is connectable to the blowing channel 62 when the door 4 is closed so that the door 4 can be air-cooled by the cooling air flow from the cooling unit 60. In particular, the door inlet 4A is formed in the upper panel 72C so that the door inlet 4A can be in communication with the cabinet outlet 16A when the door 4 is closed. Because the door inlet 4A is exposed to the outside when the door 4 is opened, it can be provided with a porous structure in order to minimize the infiltration of pollutants. For example, the door inlet 4A may be provided in the shape of a mesh or may be provided with a plurality of louvers or slot frames arranged in the up and down directions or left and right directions of the door 4. The door outlet 4B can be formed in one of the first door panel 70 and the second door panel 72. As shown in FIG. 4, the door outlet 4B is located in the first door panel 70.

In this first exemplary embodiment, the control panel 6 is located in a control panel portion 4C of the door 4. The control panel portion 4C is positioned above the air-gap 3 and a bracket 70E separates the control panel portion 4C from the air-gap 3. The bracket 70E can be integrally formed in the first door panel 70. The control panel 6 is disposed on the control panel part 4C and can be integrally formed with the door 4. The control panel 6 may include several input parts for operating inputs of the cooking apparatus according to the present invention, such as whether the door latch 84 is locked, whether the heat source of the cooking chamber is operated, or similar inputs. The control panel 6 may include one or more display parts to indicate a current status of the cooking apparatus, such as temperature of the cooking chamber, duration of operation, or similar indicators.

The door 4 includes a door handle 4D graspable by a user to allow the user to facilitate the opening/closing of the door 4. The door handle 4D can be positioned in the upper side of the door 4 below the control panel 6 to avoid interfering with the control panel 6 and to be rapidly cooled by the cooling unit 60. The door handle 4D projects away from the outer glass 74 to allow the user to easily grasp it. In other words, each of the left an right ends of the door handle 4D is contacted and coupled to the door outer glass 74 and the remaining portion of the door handle 4D is spaced from the outer glass 74 so that the user's hand can be inserted between the door handle 4D and the outer glass 74.

To prevent pollutants such as food from entering the door air-gap 3 through the door inlet 4A and the door outlet 4B to contaminate the door 4, the cooking apparatus according to first exemplary embodiment is configured to be able to open and close the door inlet 4A and the door outlet 4B. Particularly, in the present embodiment, since the door 4 is disposed to be approximately horizontal when the door 4 is opened and the door inlet 4A is positioned at the upper side of the door, food passing above the door 4 may fall into the door inlet 4A to pollute the door 4. Therefore, the cooking apparatus according to the present invention can include an opening/closing unit 90 closing the door inlet 4A to prevent pollution of the door 4 when the door 4 is opened, and opening the door inlet 4A to provide air cooling of the door 4 when the door 4 is closed. In other words, gaseous flow through the door inlet 4A is allowed when the door is closed, but the door inlet 4A is blocked when the door is in an open position.

The opening/closing unit 90 can provide an opening/closing operation by manually opening/closing the door inlet 4A or by using a powered mechanism to open/close the door inlet 4A depending on whether the door 4 is open or closed. In this first embodiment, the opening/closing unit 90 is opened and closed without power to provide a simple structure, to minimize cost, to provide easy maintenance. That is, since the door 4 is disposed to be approximately vertical when it is closed, and the door 4 is disposed to be approximately horizontal when it is opened, the opening/closing unit 90 can include a cover member 94 pivotally connected to the door 4 by a hinge 92 to open and close the door inlet 4A by means of its own weight according to whether the door 4 is opened or closed.

The hinge 92 can be positioned above the door inlet 4A when the door 4 is closed, as well as below the door inlet 4A when the door 4 is closed. In the present embodiment, the hinge 92 is positioned below the door inlet 4A when the door 4 is closed. The hinge 92 can be coupled to the second door panel 72 having the door inlet 4A formed therein by being positioned in the inside of the door air-gap 3. Alternatively, the hinge 92 can be coupled to the second door panel 72 having the door inlet 4A formed therein by being positioned outside of the door air-gap 3.

Figure 5:
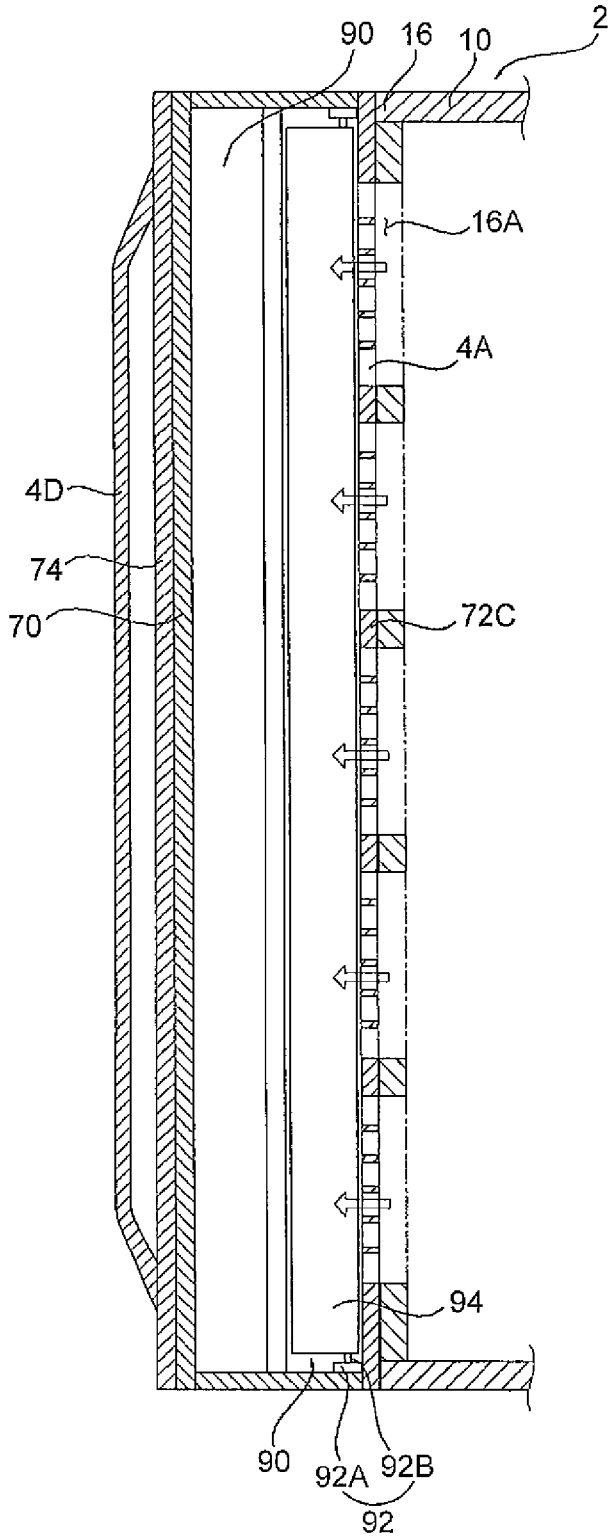
FIG. 5 is a partial cross-sectional view taken along line B-B in FIG. 1.
Figure 6:
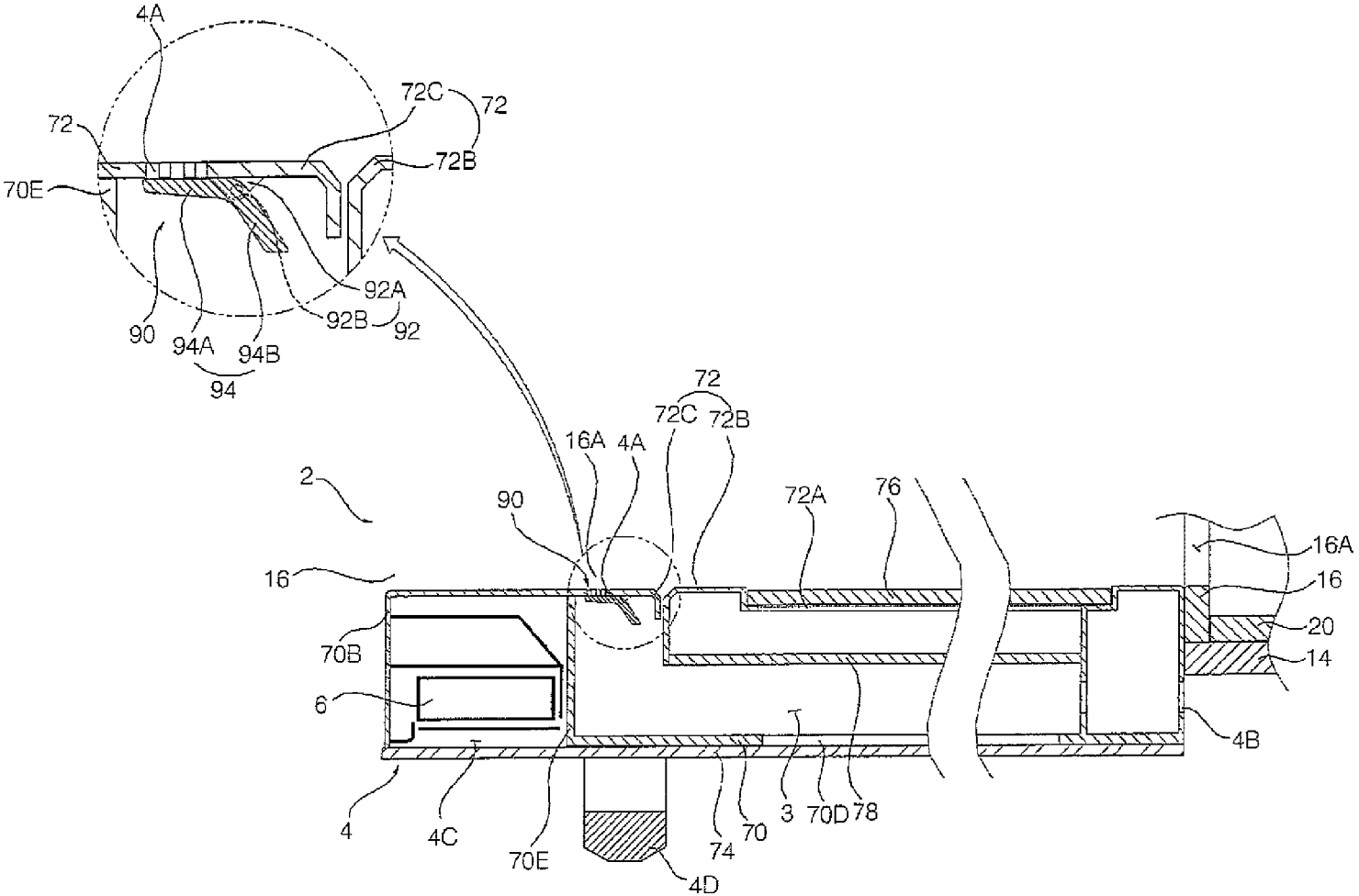
FIG. 6 is a cross-sectional view of the door similar to FIG. 4, with the door in an open position.
Figure 7:
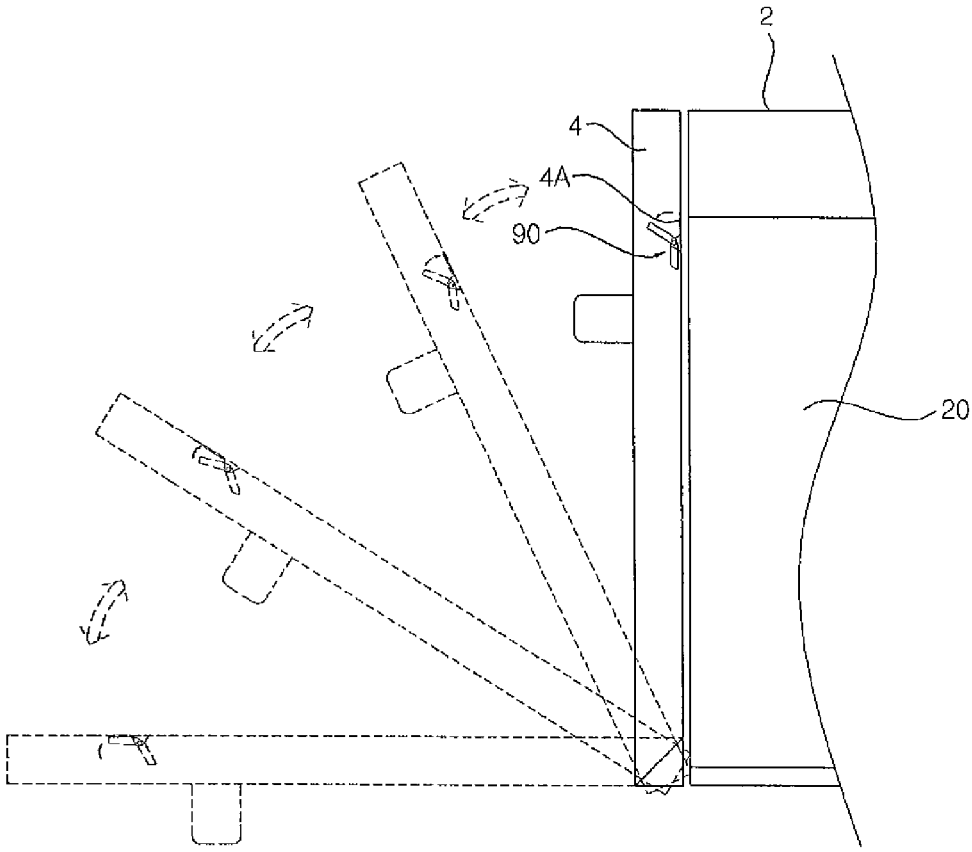
FIG. 7 is a schematic view of the cooking apparatus of FIG. 1 showing the door in various position between open and closed.
Figure 8:
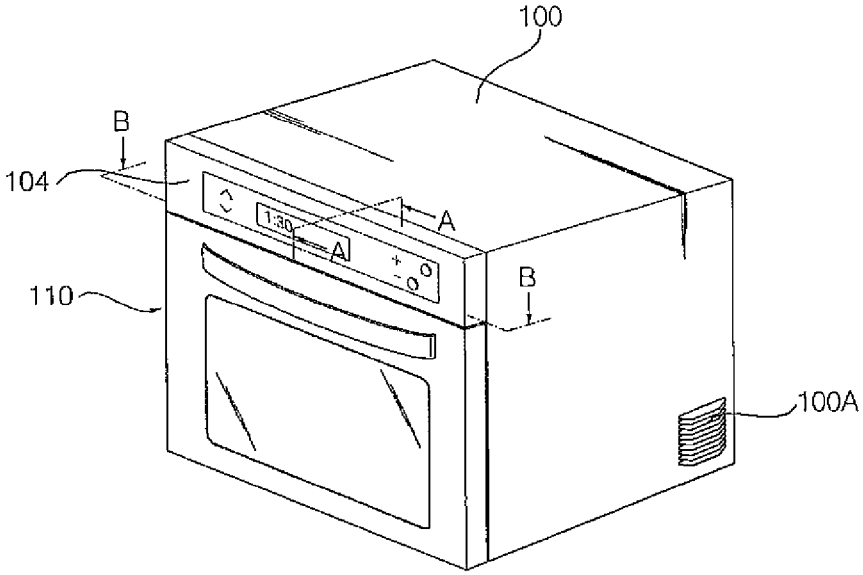
FIG. 8 is a perspective view of an external appearance of a cooking apparatus according to a second embodiment of the present invention when the door thereof is closed.
Figure 9:
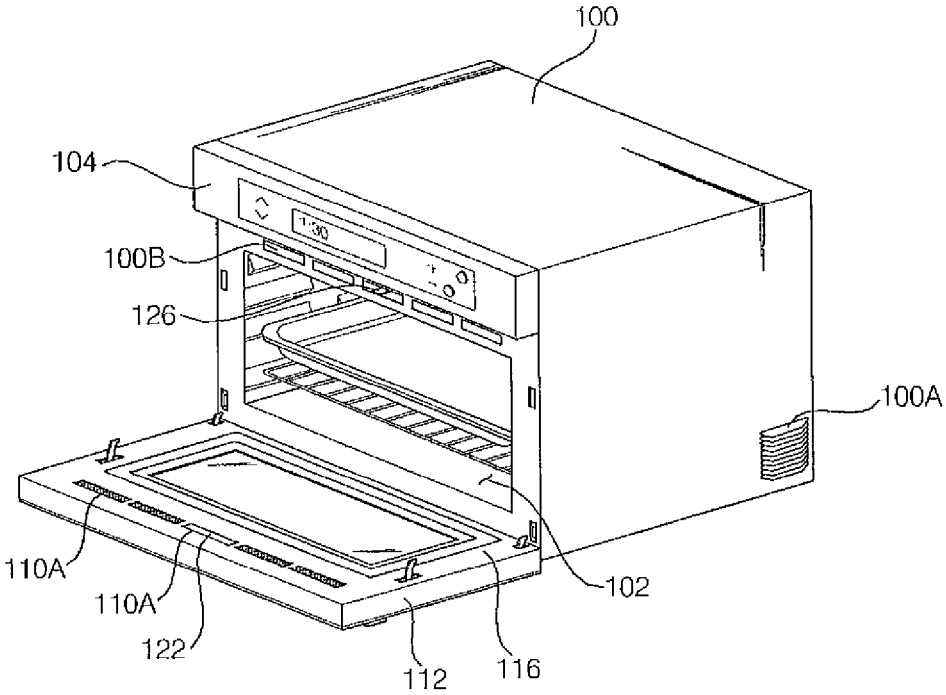
FIG. 9 is a perspective view of an external appearance of the cooking apparatus of FIG. 8 when the door thereof is opened.
Figure 10:
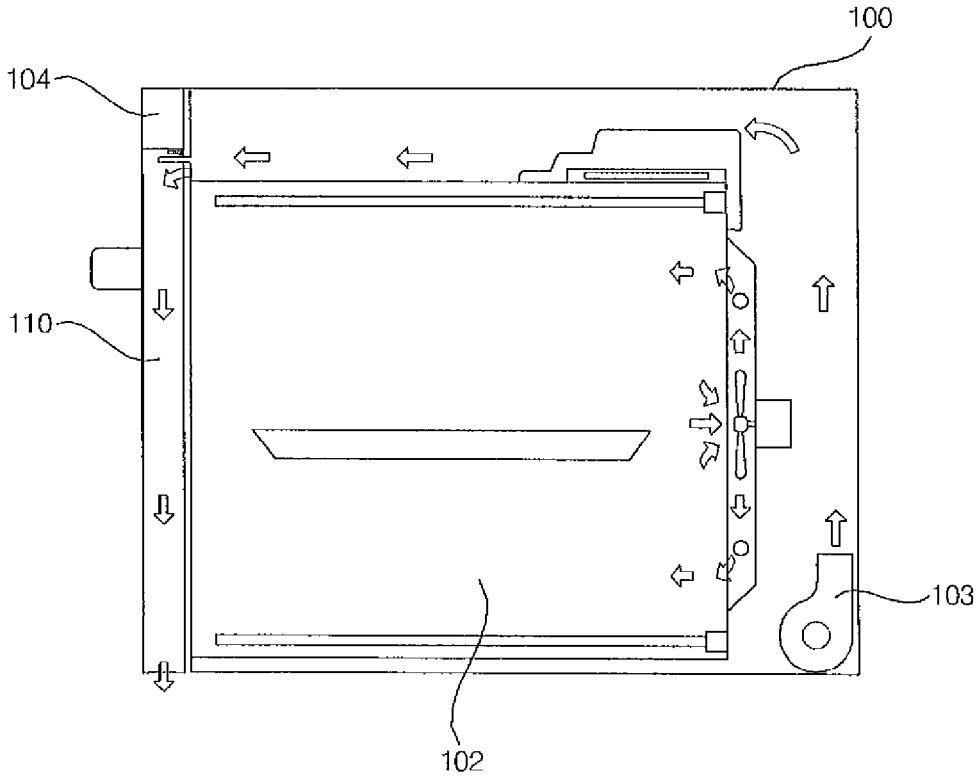
FIG. 10 is a schematic view of the cooking apparatus of FIG. 8.
Figure 11:
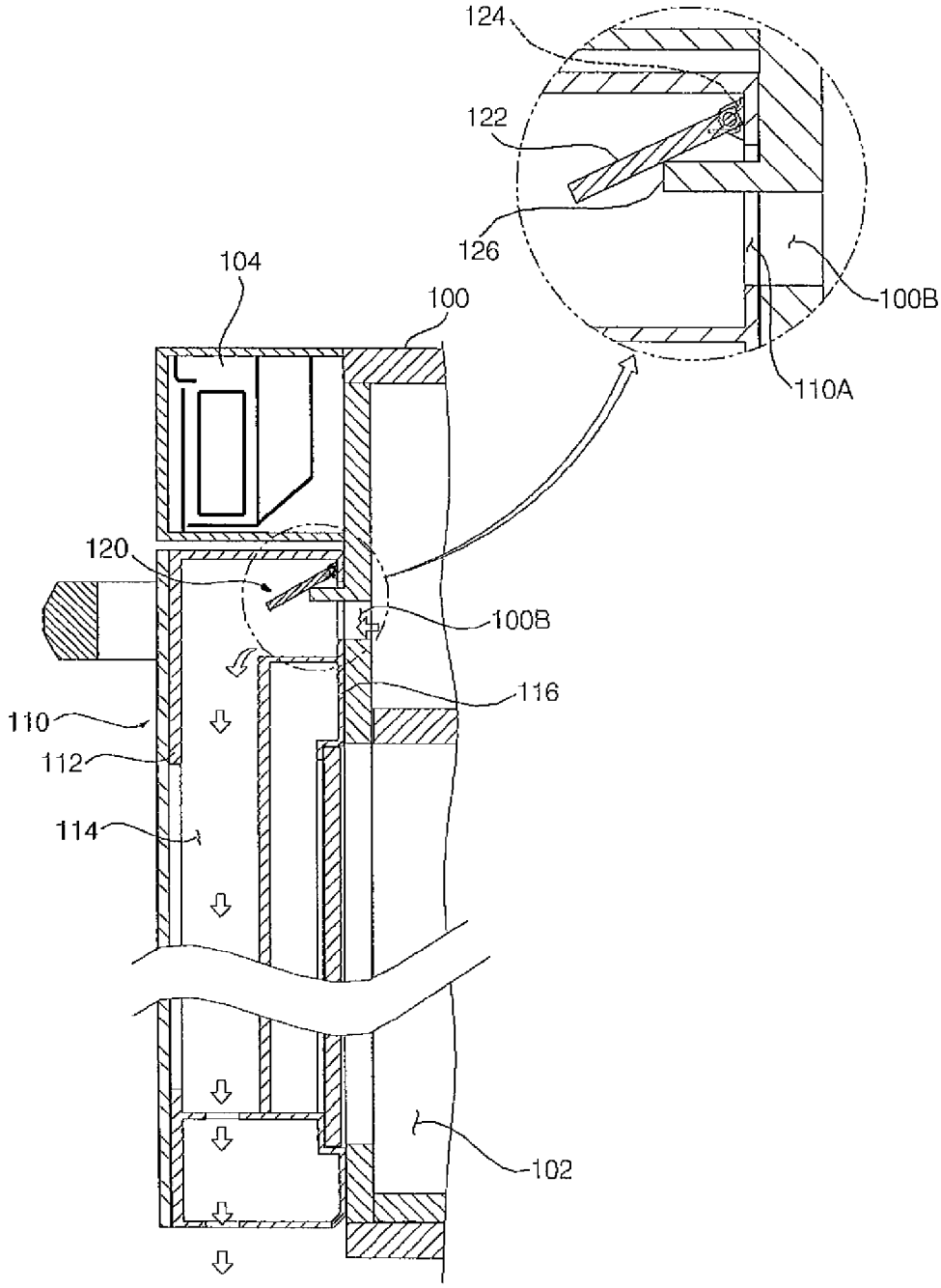
FIG. 11 is a partial cross-sectional view taken along line A-A in FIG. 8.
Figure 12:
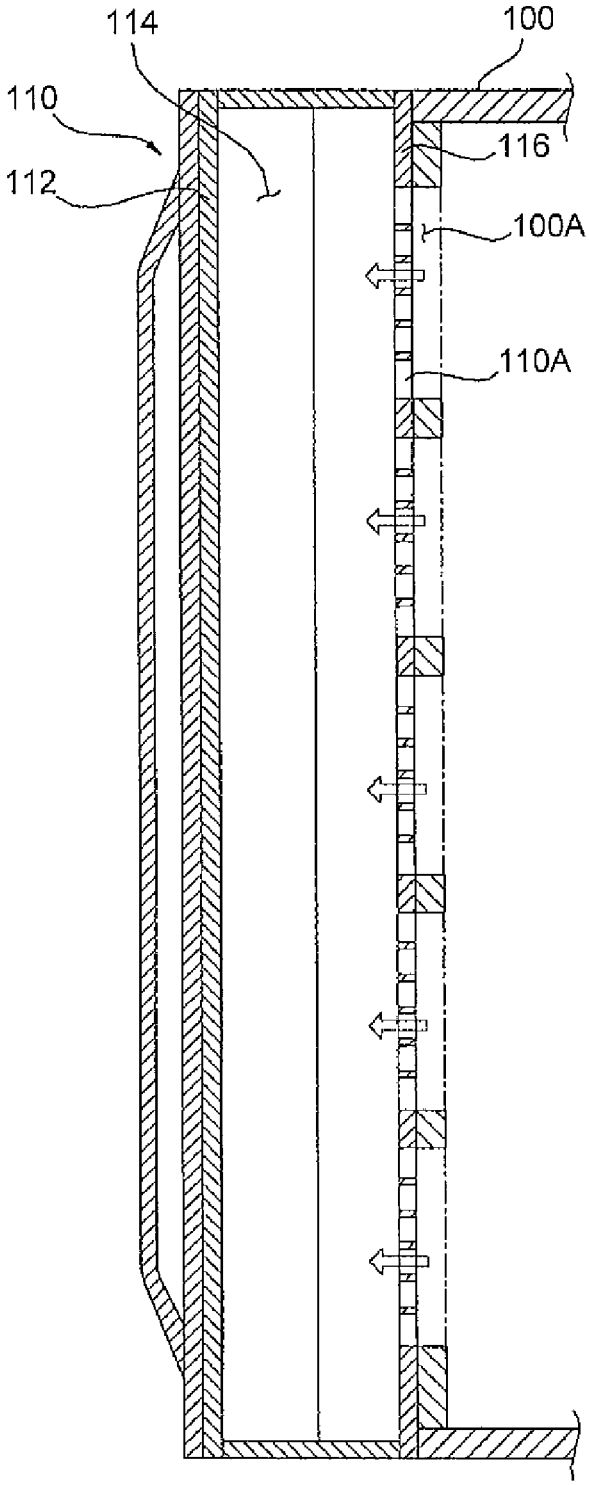
FIG. 12 is a partial cross-sectional view taken along line B-B in FIG. 8.
Figure 13:
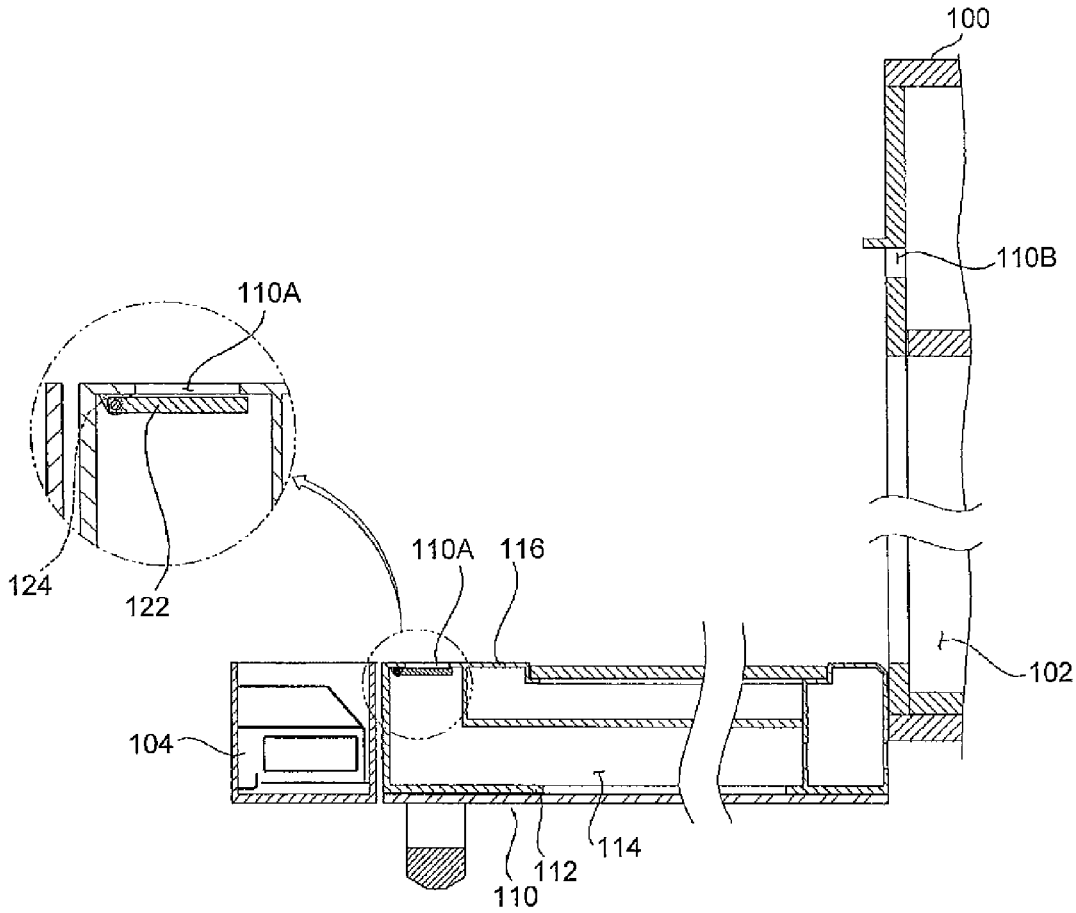
FIG. 13 is a cross-sectional view of the door similar to FIG. 11, with the door in the open position.

As best seen in FIG. 5, the hinge 92 can include an at least one boss 92A protruded from the second door panel 72 and a hinge pin 92B connecting the cover member 94 to the boss 92A. While only one boss 92A can be provided, a plurality of bosses 92A spaced from each other in a width direction can be provided, as shown in FIG. 5. The hinge pin 92B can be integrally formed with the cover member 94 or be a separate member that at least partially penetrates into the cover member 94.

The cover member 94 includes a cover part 94A capable of opening/closing the door inlet 4A, and a base part 94B extended from the cover part 94A and having mass larger than that of the cover 94A so that the center of gravity of the cover member 94 is positioned below the hinge 92 in both the open and closed position of the door 4. The cover part 94A and the base part 94B can be integrally formed, as shown in this first embodiment. Alternatively, the cover part 94A and the base part 94B can be separately formed and then assembled together. The base part 94B can be formed to be thicker relative to the cover part 94A so that is the base part 94B has a larger mass than the cover part 94A. In addition, a separate mass can be added to the base part 94B to adjust the mass of the base part 94 to have a larger mass than the cover part 94A.

The cooking apparatus according to the first exemplary embodiment may be operated to heat food or to perform a self-cleaning function. In order to heat food, a user opens the door 4 and puts food on the rack 22 in the cooking chamber 20 and then closes the door 4. Then the user operates the control panel 6 to input a cooking mode for cooking the food in the cooking chamber 20. The user operates the control panel 6 to input the cooking information or the preset algorithm, etc. so that at least one of the heat sources of the cooking chamber, such as the upper heater 32, the lower heater 34, the magnetron 36, and/or the convection heat source 40, is operated.

If the upper heater 32 is operated, the heat source by the upper heater 32 is supplied from the upper side of the cooking chamber 20 to the inside of the cooking chamber 20 by thermal conduction and thermal convection. If the lower heater 34 is operated, the heat source by the lower heater 34 is supplied to the inside of the cooking chamber 20 by thermal conduction or thermal convection. If the magnetron 36 is operated, high frequency waves generated from the magnetron 36 are supplied to the inside of the cooking chamber 20. If the convection heat source 40 is operated, the heat source of the convection heat source 40 is supplied to the cooking source 20 while being formed with compulsion convection.

As described above, if the inside of the cooking chamber 20 is supplied with at least one of the heat sources, the food in the cooking chamber 20 is cooked in the cooking mode and the pollutants in the cooking chamber 20 can be thermally decomposed and cleaned in the self cleaning mode.

In addition, as described above, if the inside of the cooking chamber 20 is heated to a high temperature, such as 500° or more, the heat from the hot air inside the cooking chamber 20 is transferred to the door 4, the control panel 6, and the machining room 50 in the cabinet 2. Accordingly, in the cooking mode, as well as in the self cleaning mode, the cooling unit 60 is operated to cool the door 4, the control panel 6, and the machining room 50 in the cabinet 2 as follows.

When the blower 64 is operated, a cooling airflow from the outside of the cooking apparatus is sucked into the blowing channel 62 in the cabinet 2 through the cabinet inlet 10A. The cooling airflow in the blowing channel 62 flows toward the cabinet outlet 16A along the blowing channel 62 to cool the machining room 50 in the cabinet 2. Because the cabinet outlet 16A and the door inlet 4A are in communication with each other, the cooling airflow arriving at the cabinet outlet 16A flows into the air-gap 3 through the cabinet outlet 16A and the door inlet 4A and is discharged from the door 4 to the outside of the cooking apparatus through the door outlet 4B. Because the cover member 94 opens the door inlet 4A by means of its own weight and the cabinet outlet 16A and the door inlet 4A are combined, the cooling airflow arriving at the cabinet outlet 16A flows in the door air-gap 3 through the cabinet outlet 16A and the door inlet 4A, thereby providing gaseous flow through the channel defined by the air-gap 3.

Because the cooling airflow flows through the air-gap 3 to the door outlet 4B along the air-gap 3, the airflow cools the door 4. As a result, when the user contacts the door 4, particularly the door handle 4D, the user does not get burned. Because of the arrangement of the cooling duct 62 and the door inlet 4A, the cooling airflow is sucked through the door inlet 4A and flows downwardly along the air-gap 3 to provide a buffer between the control panel 6 and the hot air generated from the high temperature of the cooking chamber 20 so that the hot air does no flow to the control panel 6. As a result, the control panel 6 remains cool to the touch.

After the cooking mode or the self cleaning mode is completed, if the user holds the door handle 4D and pulls up it forwardly so that the door 4 is disposed to be approximately horizontal, the inside of the cooking chamber 20 can be cleaned and any thermally decomposed pollutants can be removed. At this time, if the door is opened to be approximately horizontally disposed, the cover part 94A of the cover member 94 is rotated toward the second door panel 72 by means of its own weight to shield the door inlet 4A. Therefore, although pollutants may fall onto the door 4 in this position, the pollutants do not enter the door air-gap 3. As a result, pollution in the door air-gap 3 is prevented and the cleaning of the pollutants falling on the door 4 is improved.

A cooking apparatus according to a second embodiment of the present invention is shown in FIGS. 8-13. Because the cooking apparatus according to the present embodiment is similar to the cooking apparatus according to the first embodiment of the present invention, except for the specific features of the opening/closing unit, description of similar features will not be repeated.

The cooking apparatus according to the present invention includes a cabinet 100 provided with a cooking chamber 102 and a blower 103 located therein, a control panel 104 located in the front upper side part of the cabinet 100, and a door 110 positioned below the control panel 102 and configured to open and close the cooking chamber 102. The cabinet 100 includes a cabinet inlet 100A to suck a cooling air into the cabinet 100 and a cabinet outlet 100B to discharge the cooling air out of the cabinet 100. The cabinet outlet 100B is positioned below the control panel 104 on the front of the cabinet 100 so that the cooling air, having cooled the cabinet 100, can flow into the door 110.

The door 110 includes a first door panel 112 and a second door panel 116 positioned between the first door panel 112 and the cooking chamber 102 so that a door air-gap 114 is provided between the first door panel 112 and the second door panel 116. The second door panel 116 includes a door inlet 110A connected to one side of the door air-gap 114 and corresponds to the cabinet outlet 100B when the door 100 is closed. At least one of the first and second door panels 112 and 114 is provided with a door outlet 110B communicating with the other end of the door air-gap 114. The door inlet 110A can be opened and closed by an opening/closing unit 120 as described below according to whether the door 110 is opened or closed.

The opening/closing unit 120 includes a cover member 122 pivotally connected to the door 110 to open and close the door inlet 110A, an elastic member 124 provided between the door 110 and the cover member 122 to provide elastic force that biases the cover member 122 towards the door inlet 110A, and a push rod 126 protruded from the cabinet 100 to push the cover member 122 such that the door inlet 110A is opened when the door 110 is closed.

The cover member 122 can be connected to the door above the door inlet 110A as well as below the door inlet 110A. Alternatively, the cover member 122 can be pivotally connected to the door 110 to allow the cover member 122 to be rotated between the inside and the outside of the door 4.

The elastic member 124 can be implemented as a coil spring, a spiral spring, or a plate spring. The elastic member can be implemented by other various methods so long as the cover member 122 is biased towards the door inlet 110A. The push rod 126 is positioned to correspond to the door inlet 110A in order to be able to be inserted into the door inlet 110A when the door 110 is closed.

When the blower 103 is driven in the state where the door 110 is closed and the door inlet 110A is opened, a cooling air is sucked from outside of the cooking apparatus into the cabinet 110 through the cabinet inlet 100A to cool the inside of the cabinet. Because the cabinet outlet 100B and the door inlet 110A are in communication with each other, the cooling airflow arriving at the cabinet outlet 100B flows into the air-gap 114 through the cabinet outlet 100B and the door inlet 110A and is discharged from the door 110 to the outside of the cooking apparatus through the door outlet 110B.

When the door 110 is closed, the push rod 126 is inserted into the door inlet 110A to push the cover member 122 from the door inlet 110A so that the door inlet 110A is opened. When the door 110 is opened, the push rod 126 is removed from the door inlet 110A and the cover member 122 rotates toward the door inlet 110A by means of the elastic force of the elastic member 124, thereby closing the door inlet 110A. In this manner, gaseous flow is provided through door air-gap 114 when the door 110 is closed and pollutants are prevented from entering the door air-gap 114 when the door is opened.

Figure 14:
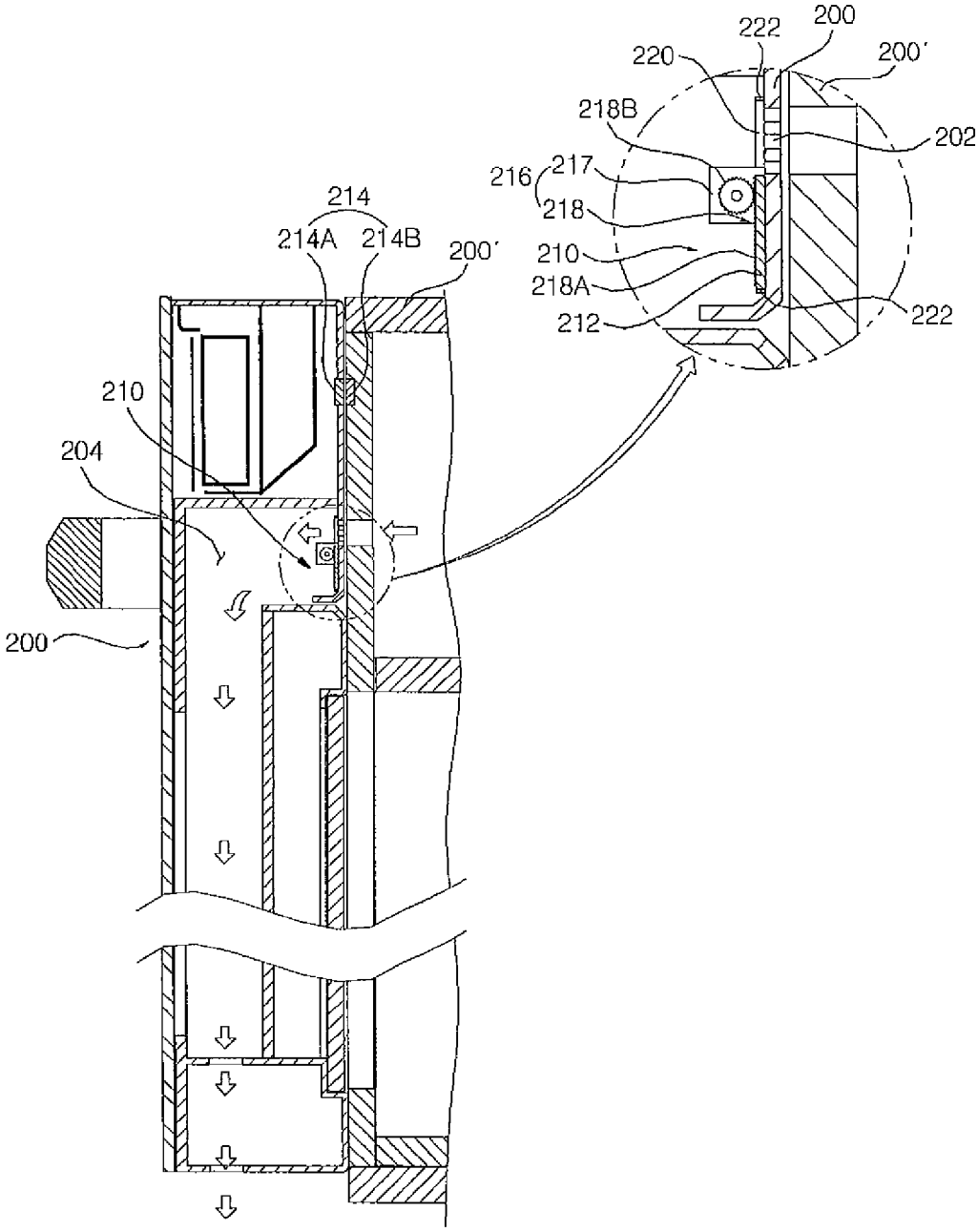
FIG. 14 is a cross-sectional view a cooking apparatus according to a third embodiment of the present invention similar to that of FIG. 4.
Figure 15:
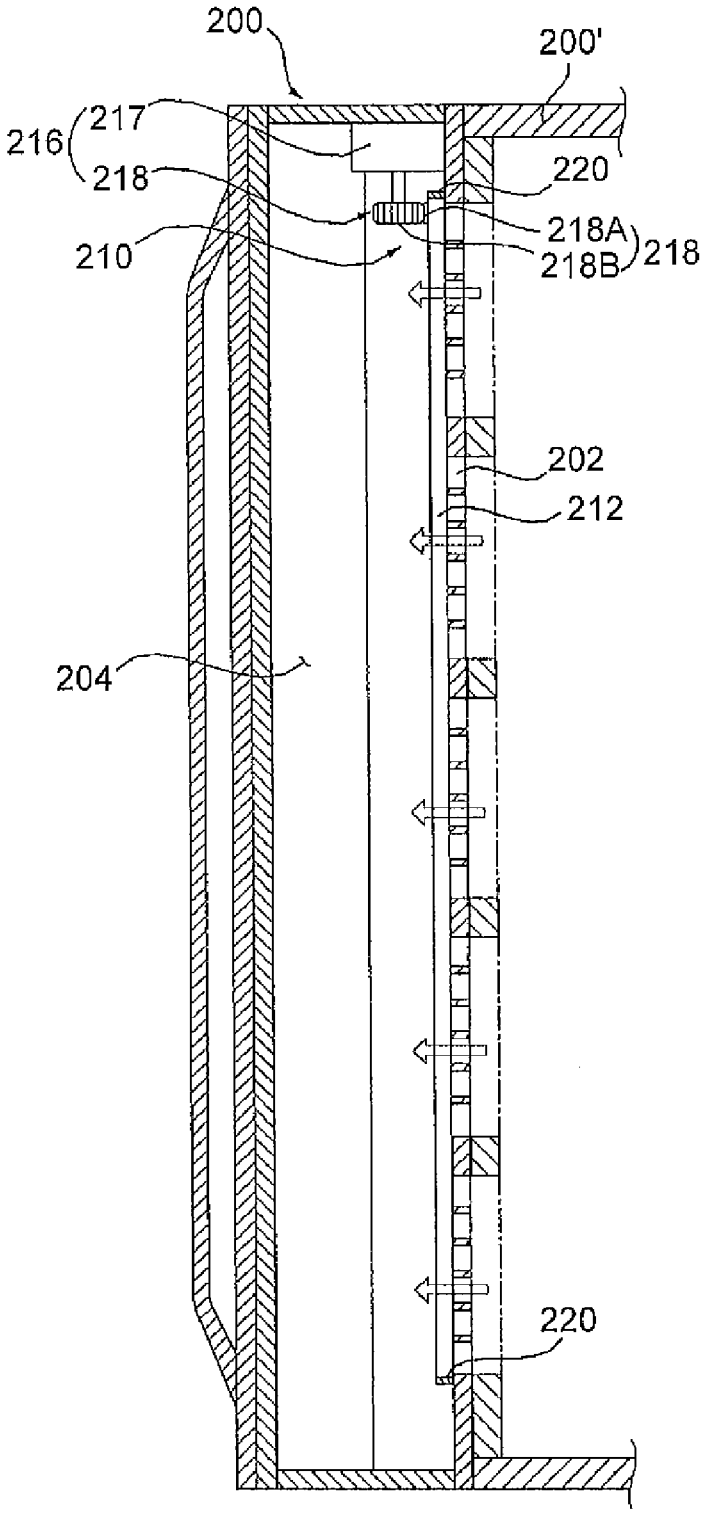
FIG. 15 is a cross-sectional view of the cooking apparatus of FIG. 14 similar to that of FIG. 5.
Figure 16:
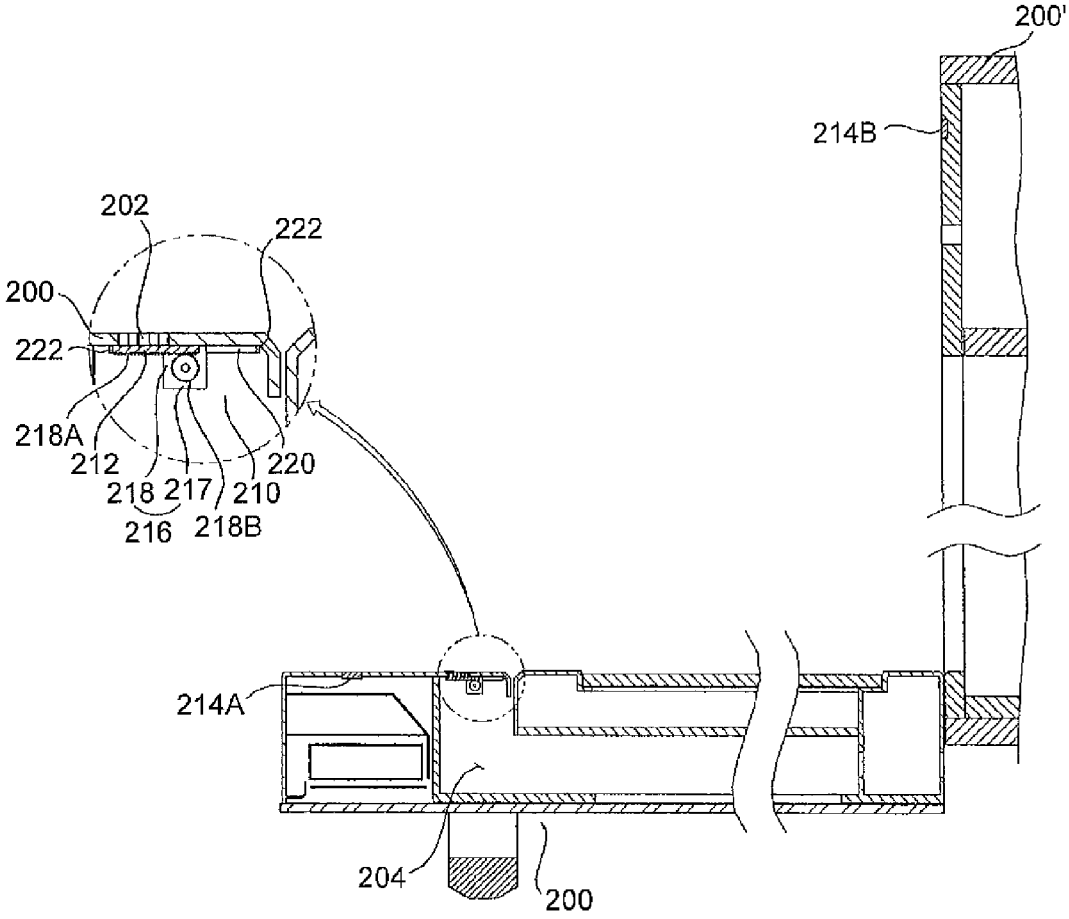
FIG. 16 is a cross-sectional view of the cooking apparatus of FIG. 14 similar to that of FIG. 6.

A cooking apparatus according to a third embodiment of the present invention is shown in FIGS. 14-16. Because the cooking apparatus according to the present embodiment is similar to the cooking apparatus according to the first and second embodiments of the present invention, except for the specific features of the opening/closing unit, description of similar features will not be repeated.

The opening/closing unit 220 according to the present embodiment uses power to control the opening/closing operation of the opening/closing unit 220. In this embodiment, the opening/closing unit includes a cover member 212 capable of opening/closing a door inlet 202 of a door 200 by being slid with respect to the door inlet 202, a door sensor 214 sensing the opening/closing of the door 200, and an actuator 216 allowing the cover member 212 to open and close the door inlet 202 according to signals from the door sensor 214.

The cover member 212 can be positioned in the inside of the door 200, i.e., door air-gap 204, as well as positioned on the outside of the door 200. In the present embodiment, the cover member 200 is positioned in the inside of the door air-gap 204 to provide a simple appearance for the outer surface of the door.

The cover member 212 can slide in the opening direction of the door inlet 202, that is, the thickness direction of the door 200, as well as a length direction or a width direction of the door 200. In this embodiment, the cover member 212 slides in the length or width direction of the door 200 so that the cover member 212 can maintain contact with the door 200. Preferably, the cover member 212 slides in the length direction of the door so that if a plurality of door inlets 202 are provided, the cover member 212 may open and close the door inlets 202 simultaneously.

The door sensor 214 can be implemented using a switch scheme, a photo diode scheme using infrared rays, among other sensing mechanisms. As shown in the present embodiment, the door sensor 214 is implemented as a photo sensor scheme where the door sensor 214 includes a first sensor 214A formed on one side of the door 200 and a second sensor 214B provided in the cabinet 200'. The first and second sensors 214A and 214B are positioned to be aligned with each other when the door 200 is closed against the cabinet 200'.

The actuator 216 is a linear motor directly coupled to the cover member 212 to slide the cover member 212 by transferring power from a power generation source, such as a motor, to the cover member 212 through a power transfer unit, such as a belt and pulley system or a gear system. In the present embodiment, the actuator 216 includes a motor 217 that generates a rotating force and a power transfer unit 218 that transforms the rotating force of the motor 217 into a linear force to that moves the cover member 212 up and down.

The motor 217 can be driven so that a cooling air current enters and exits through the door inlet 202 when the door 200 is closed. The motor can also be driven so that the cover member 212 blocks the door inlet 202 when the door 200 is opened, thereby preventing pollutants from entering the door air-gap 204 when the door 200 is opened.

By way of example, the power transfer unit 218 is a rack and pinion system. In particular, the power transfer unit 218 includes a rack gear 218A coupled to the cover member 212 in the sliding direction of the cover member 212 and a pinion gear 218B coupled to the motor 217. The teeth of the rack gear 218A engage the teeth of the pinion gear 218B.

In addition, the opening/closing unit 210 can further include a cover member guide 220 provided in the door 200 to guide the sliding of the cover member 212. A cover member retainer 222 may also be provided in the door 200 that extends substantially perpendicular to the sliding direction of the cover member 212 to limit the sliding stroke of the cover member 212, and at the same time, support the cover member 212.

When the door 200 is detected by the door sensor 214 as being in the closed position, the cover member 212 is slid to the upper side or the lower side of the door inlet 202 by the actuator 216 so that the door inlet 202 is opened. When the door 200 is detected by the door sensor 214 as being in the open position, the cover member 212 is slid to cover door inlet 202 by the actuator 216 so that the door inlet 202 is closed.

Figure 17:
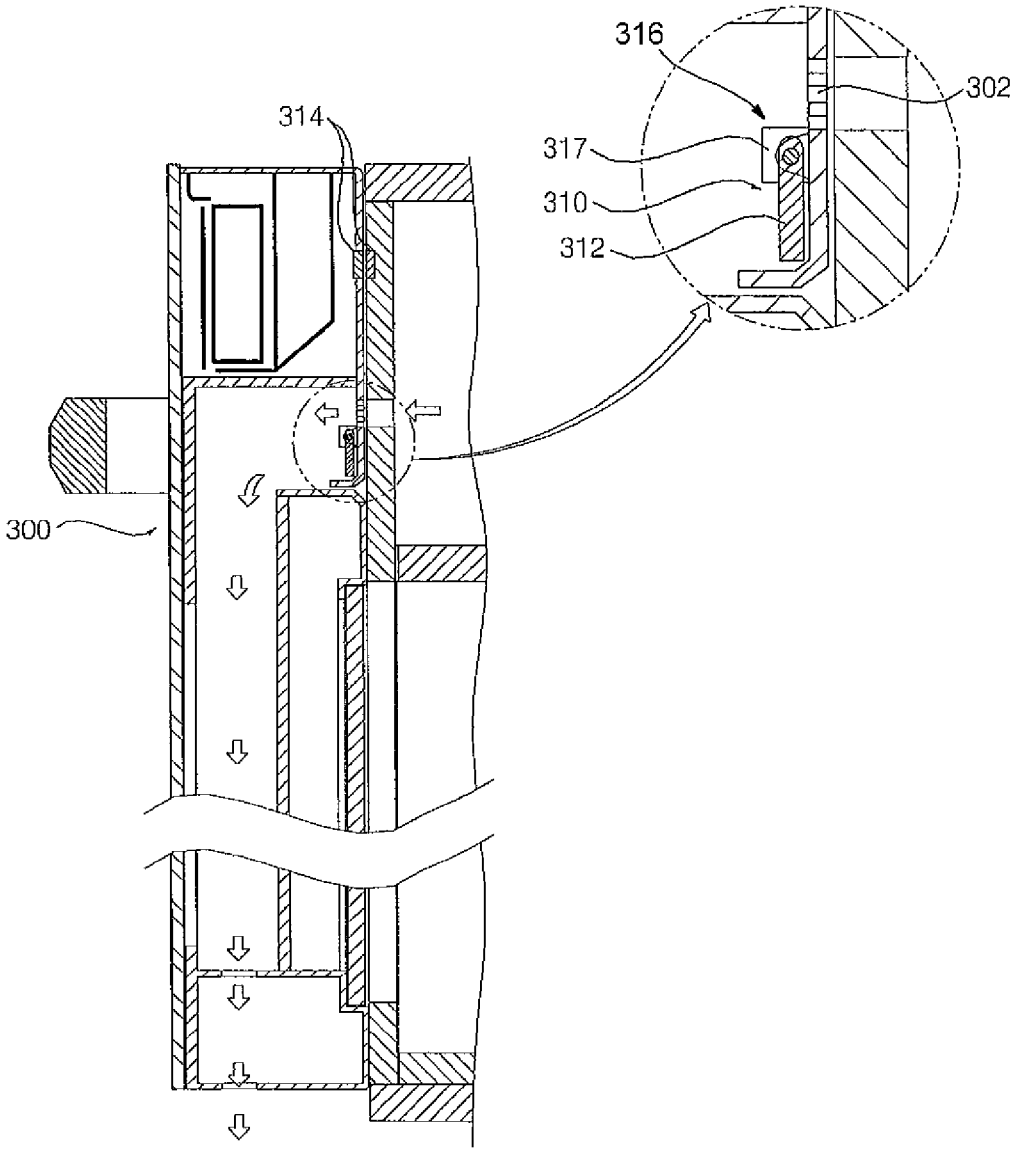
FIG. 17 is a cross-sectional view of a cooking apparatus according to a fourth embodiment of the present invention similar to that of FIG. 4.
Figure 18:
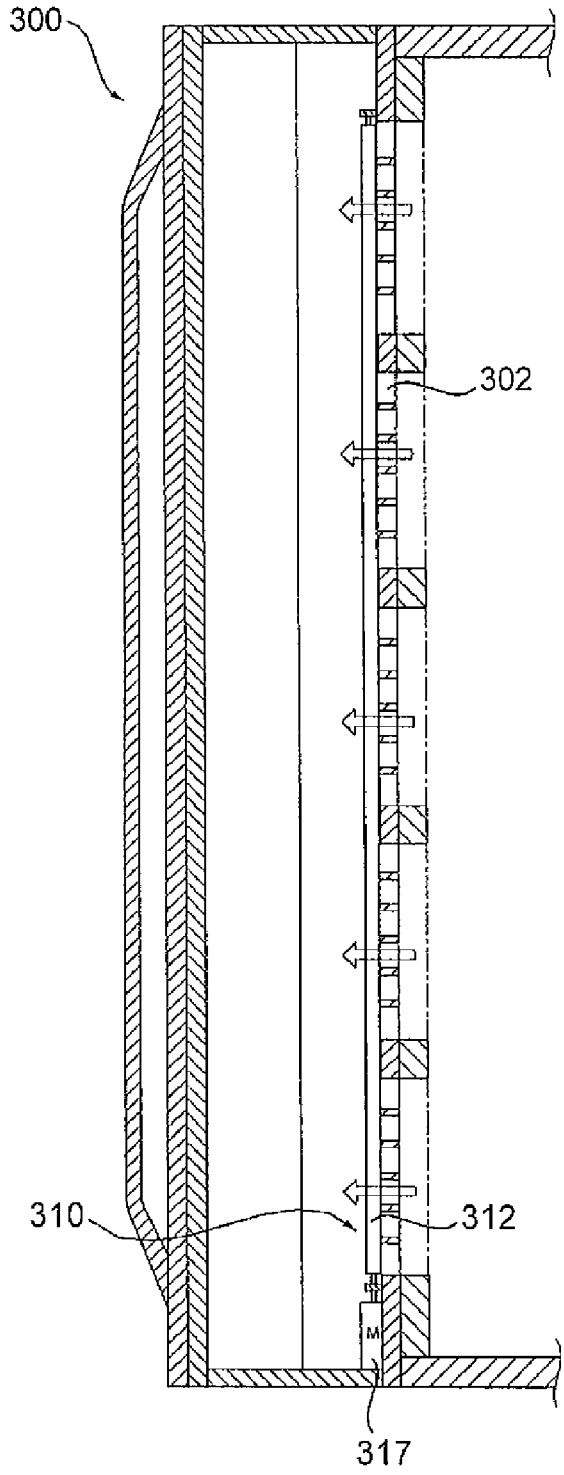
FIG. 18 is a cross-sectional view of the cooking apparatus of FIG. 17 similar to that of FIG. 5.
Figure 19:
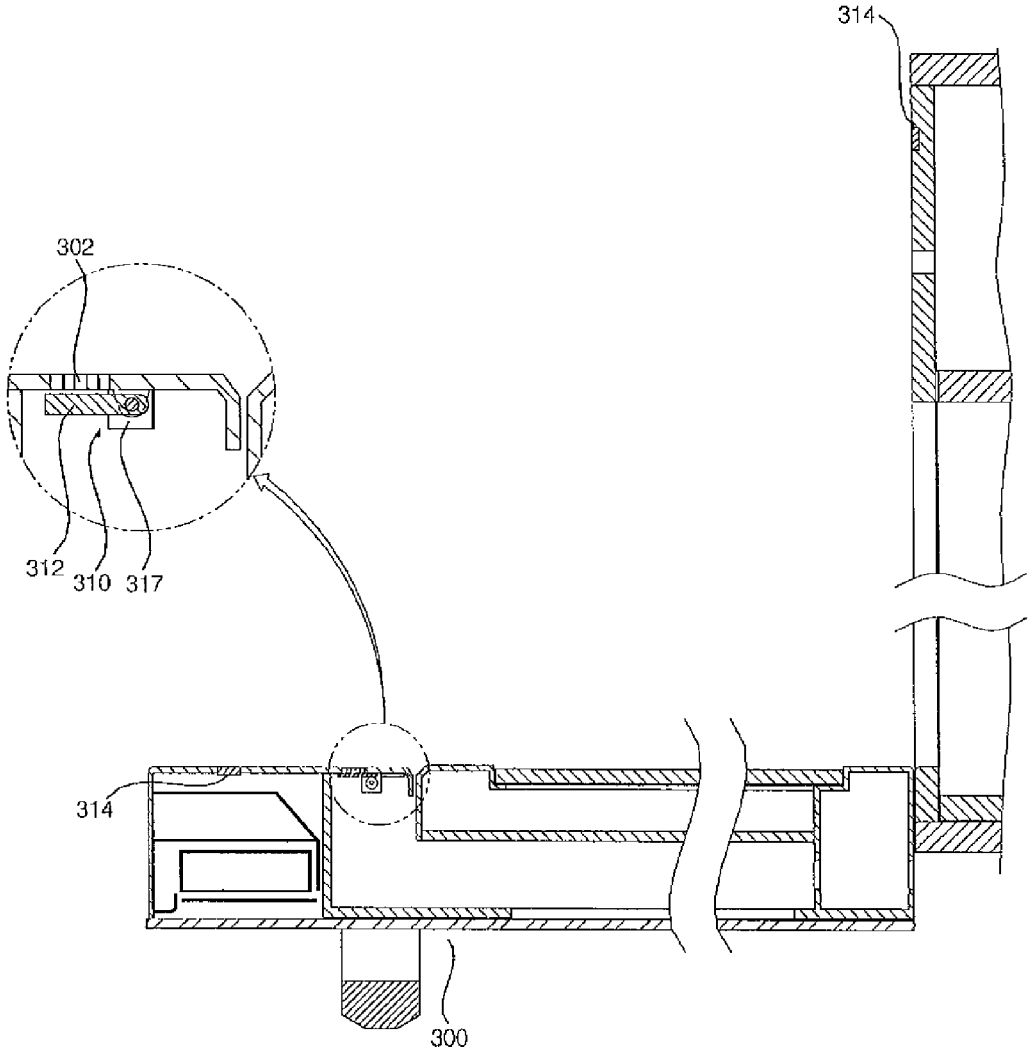
FIG. 19 is a cross-sectional view of the cooking apparatus of FIG. 17 similar to that of FIG. 6.

A cooking apparatus according to a fourth embodiment of the present invention is shown in FIGS. 17-19. Because the cooking apparatus according to the present embodiment is similar to the cooking apparatus according to the embodiments of the present invention described above, except for the specific features of the opening/closing unit, description of similar features will not be repeated.

The opening/closing unit 310 according to the present embodiment uses power to control the opening/closing operation of the opening/closing unit 310. In this embodiment, the opening/closing unit 310 includes a cover member 312 pivotally connected to the door 300 to be able to open and close the door inlet 302 of the door 302, a door sensor 314 sensing the opening/closing of the door 300, and an actuator rotating the cover member 312 according to the signals from the door sensor 314.

The actuator may provide power directly to the cover member 312 or may indirectly provide power to the cover member. For example, a power generation source, such as a motor, may be directly coupled to the cover member 312 or the power generation source, such as a motor, may be connected to the cover member 212 through a power transfer unit such as a belt & pulley system or a gear system. In the present embodiment, the cover member actuator 316 includes a motor 317 directly coupled to the cover member 312. Accordingly, the opening/closing unit 310 rotates the cover member 312 by means of the rotating force of the motor 317, thereby allowing the door inlet 302 to be opened and closed by the cover member 312.

Figure 20:
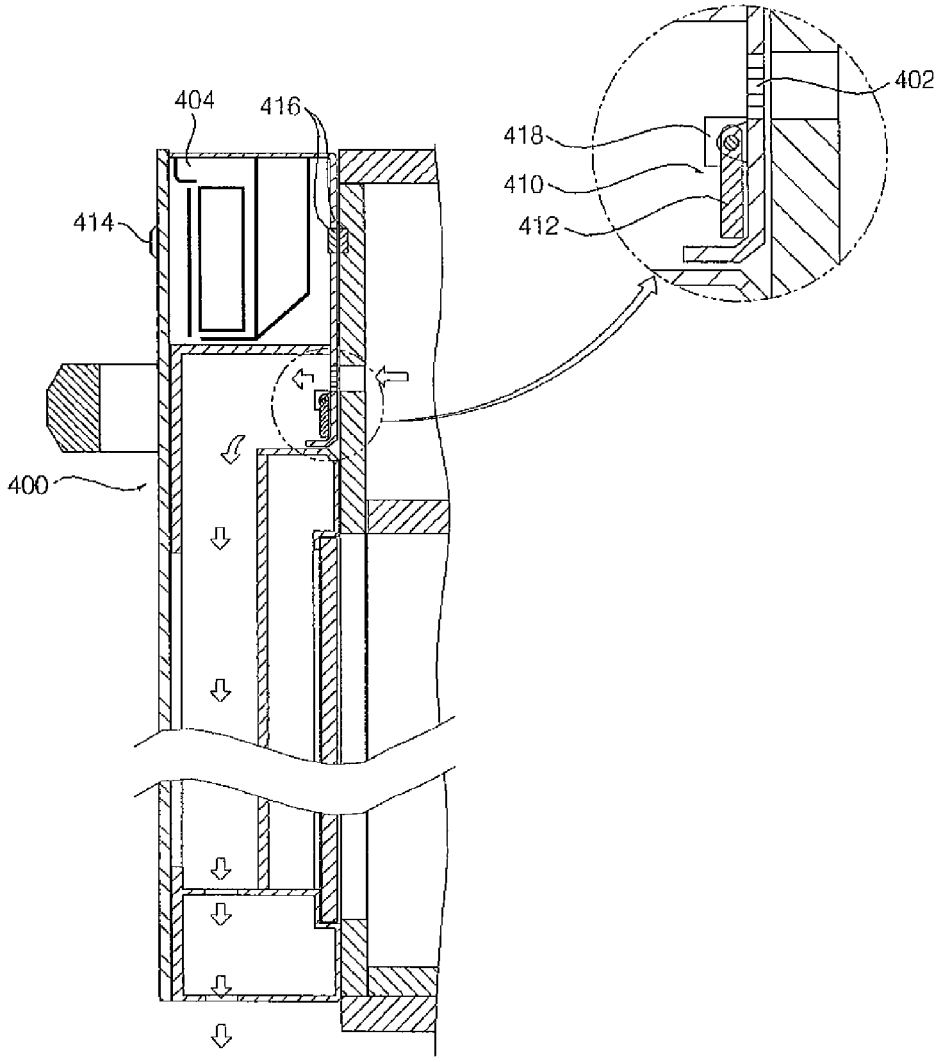
FIG. 20 is a cross-sectional view of a cooking apparatus according to a fifth embodiment of the present invention similar to that of FIG. 4.
Figure 21:
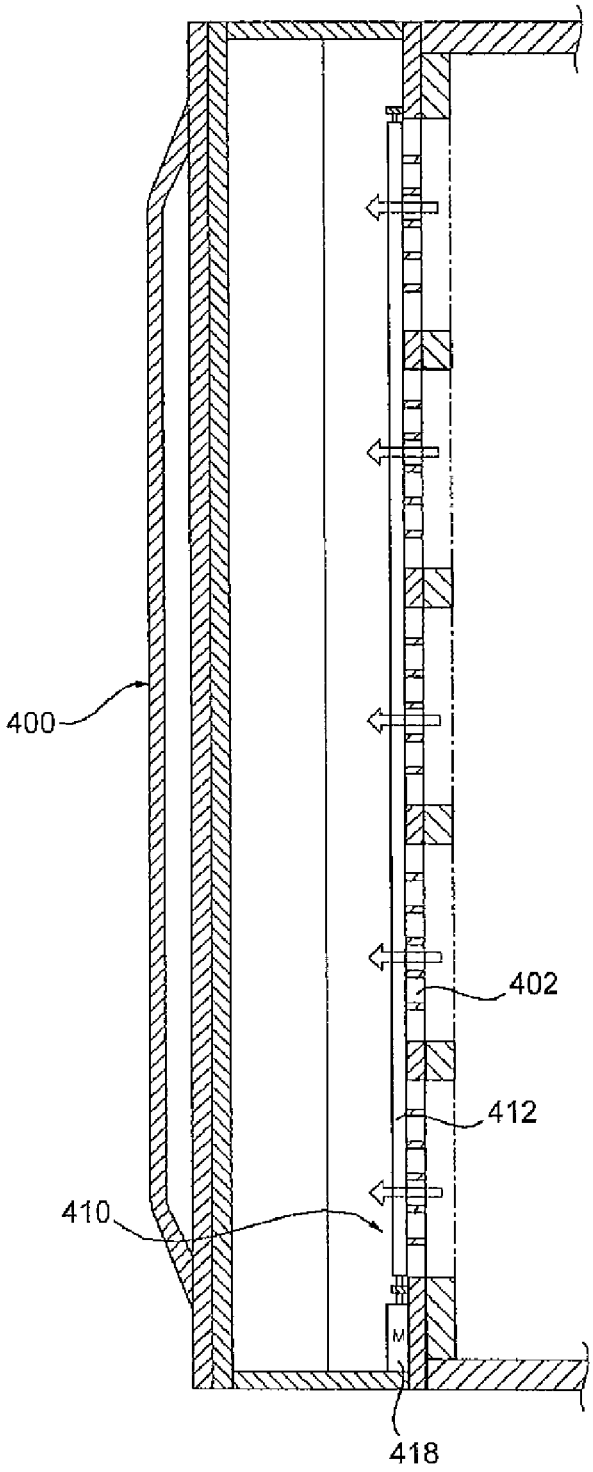
FIG. 21 is a cross-sectional view of the cooking apparatus of FIG. 20 similar to that of FIG. 5.
Figure 22:
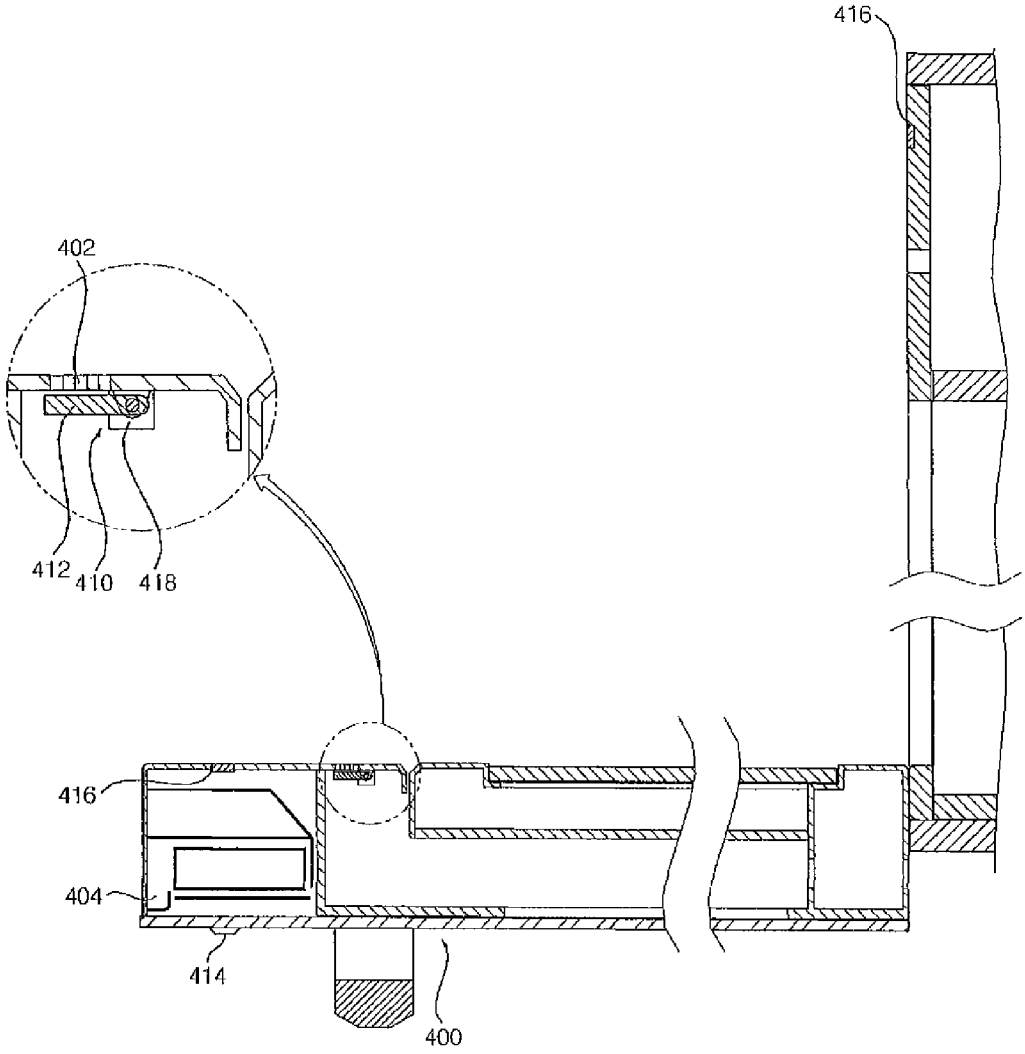
FIG. 22 is a cross-sectional view of the cooking apparatus of FIG. 21 similar to that of FIG. 6.

A cooking apparatus according to a fifth embodiment of the present invention is shown in FIGS. 20-22. Because the cooking apparatus according to the present embodiment is similar to the cooking apparatus according to the embodiments of the present invention described above, except for the specific features of the opening/closing unit, description of similar features will not be repeated.

The opening/closing unit 410 of the present embodiment includes switch 414 capable of being manually operated by users, a door sensor 416 sensing the opening/closing of the door 400, and an actuator 418 allowing the cover member 412 to open and close the door inlet 402 according to signals from the door sensor 416 or the switch 414. In the situation where a control panel 404 is separated from the door 400 and is installed in a cabinet 406, the opening/closing unit switch 414 can be positioned on the control panel 404 in order to facilitate the manual operation by the users of the cooking apparatus.

In the present embodiment, when it is required that the door inlet 402 be opened when the door 400 is closed and the door inlet 402 is closed when the door 400 is open, the state of the door 400 is sensed via the door sensor 416, the door inlet 402 can be opened by means of the cover member 412, and when the opening state of the door 400 is sensed through the door sensor 416, the door inlet 402 can be closed by means of the cover member 412.

Furthermore, the closing of the door inlet 402 can be overridden by a user pressing switch 414. Specifically, even if the door sensor 416 detects the door 400 as being in an open position, the door inlet 402 can be opened if a user presses switch 414 thereby causing the cover member 412 to open the door inlet 402. Thus, the door inlet 402 is opened when the door 400 is opened, thereby making it possible to clean the inside of the door 400.

As described above in detail, the cooking apparatus of the present invention has an advantage that because the door is provided with a door air-gap, air cooling of the door can be performed. Because the door inlet connected to the door air-gap can be opened and closed by means of the opening/closing unit, the infiltration of pollutants into the door air-gap through the door inlet can be prevented when the door is opened. As a result, the clearness of the door and the visualization of the cooking chamber through the door can be maintained.

In addition, the cooking apparatus of the present invention has an advantage that in the situation where the opening/closing unit includes a cover member capable of opening/closing the door inlet by means of its own weight or the opening/closing unit includes a cover member, a push rod, and an elastic member, the door inlet can be opened and closed without a separate power source. As a result, the opening/closing unit can be simplified, its manufacturing costs can be reduced, and it is more easily maintained.

The cooking apparatus of the present invention has an advantage that in the situation where the opening/closing unit includes a cover member capable of opening/closing the door inlet, and an actuator for moving the cover member to open and close the door inlet, the operation of the cover member becomes certain because the opening/closing of the door is powered by the actuator.

When the cooking apparatus of the present invention has an opening/closing unit that includes a door sensor sensing the opening/closing of the door, the opening/closing of the door can be controlled based on signals from the sensor thereby increasing the certainty of operation of the cover member.

If a switch is provided as part of the cooking apparatus, the cover member of the opening/closing unit can be operated so that the door inlet is open to allow for cleaning of the interior of the door even when the position of the door would otherwise cause the cover member to close the door inlet.

The invention thus being described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A cooking apparatus comprising:

a cooking chamber having an opening;

a door configured to open and close the opening of the cooking chamber, the door including a channel and an inlet to allow communication between the cooking chamber and the channel; and an opening/closing unit to open and close the inlet in the door, wherein the opening/closing unit includes a cover member located in the door so that the inlet of the door can be opened and closed by the weight of the cover member based on whether the door is in an open position or a closed position.

2. The cooking apparatus of claim 1, wherein the channel of the door includes an air-gap located in the door, and the inlet is formed on a surface of the door closest to the cooking chamber and is connected to at least one side of the air-gap.

3. The cooking apparatus of claim 1, wherein the cover member is located substantially adjacent the inlet of the door.

4. The cooking apparatus of claim 3, wherein the cover member is pivotally connected to the door by a hinge positioned below the inlet of door.

5. The cooking apparatus of claim 4, wherein the cover member includes:

a cover part configured to open and close the inlet of the door; and a base part extended from the cover part such that the center of gravity of the cover member is located beneath the hinge when the door is in the open position and the closed position.

6. The cooking apparatus of claim 5, wherein the base part is formed of the same material as the cover part and has a larger mass than the cover part.

7. The cooking apparatus of claim 5, wherein the opening/closing unit includes a mass member connected to the base part.

8. The cooking apparatus of claim 3, wherein the cover member includes:

a cover part configured to open and close the inlet of the door; and a base part extended from the cover part such that the center of gravity of the cover member is located in the base part.

9. The cooking apparatus of claim 1, further comprising:

a cabinet including a blowing channel positioned at the outside of the cooking chamber; and a blower to generate airflow in the blowing channel, wherein the airflow passes through the door inlet when the door is in the closed position.

10. A cooking apparatus comprising:

a cooking chamber having an opening;

a door configured to open and close the opening of the cooking chamber, the door including a gaseous flow path and an inlet to allow communication between the cooking chamber and the gaseous flow path; and an opening/closing unit to open and close the inlet in the door, wherein the opening/closing unit includes a cover member located in the door so that the inlet of the door can be opened and closed by the weight of the cover member based on whether the door is in an open position and a closed position.

11. The cooking apparatus of claim 10, wherein the cover member is pivotally connected to the door by a hinge positioned below the inlet of door.

12. The cooking apparatus of claim 11, wherein the cover member includes:

a cover part configured to open and close the inlet of the door; and a base part extended from the cover part such that the center of gravity of the cover member is located beneath the hinge when the door is in the open position and the closed position.

13. A door for a cooking apparatus, the door comprising:

a first surface;

a second surface spaced from the first surface to define a channel between the first surface and the second surface;

an inlet formed in the second surface, the inlet being in flow communication with the channel;

an outlet formed in one of the first surface and the second surface, the outlet being in flow communication with the channel; and an opening/closing unit to open and close the inlet in the second surface wherein the opening/closing unit includes a cover member located in the door so that the inlet of the door can be opened and closed by the weight of the cover member based on whether the door is in a vertical position or a horizontal position.

* * * * *